US011846141B2

(12) United States Patent
Skibsrud et al.

(10) Patent No.: US 11,846,141 B2
(45) Date of Patent: Dec. 19, 2023

(54) GUIDE ARM

(71) Applicant: CAMERON INTERNATIONAL CORPORATION, Houston, TX (US)

(72) Inventors: Rune Skibsrud, Bygland (NO); Jean-Philippe Huchon, Kristiansand (NO); Dag Holen, Kristiansand (NO)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 17/413,155

(22) PCT Filed: Dec. 10, 2019

(86) PCT No.: PCT/US2019/065463
§ 371 (c)(1),
(2) Date: Jun. 11, 2021

(87) PCT Pub. No.: WO2020/123494
PCT Pub. Date: Jun. 18, 2020

(65) Prior Publication Data

US 2022/0034176 A1 Feb. 3, 2022

Related U.S. Application Data

(60) Provisional application No. 62/778,197, filed on Dec. 11, 2018.

(51) Int. Cl.
*E21B 15/00* (2006.01)
*E21B 19/14* (2006.01)
(Continued)

(52) U.S. Cl.
CPC ..... *E21B 15/003* (2013.01); *E21B 15/00* (2013.01); *E21B 19/087* (2013.01); *E21B 19/14* (2013.01); *E21B 19/24* (2013.01)

(58) Field of Classification Search
CPC ..... E21B 15/00; E21B 15/003; E21B 19/087; E21B 19/14; E21B 19/24
See application file for complete search history.

(56) References Cited

U.S. PATENT DOCUMENTS 3,404,741 A 10/1968 Aldea
4,274,778 A * 6/1981 Putnam ..... E21B 19/14 414/733

(Continued)

FOREIGN PATENT DOCUMENTS

DE 102009043081 A1 3/2011
EP 0472583 A1 3/1992

(Continued)

OTHER PUBLICATIONS

Search Report and Written Opinion of International Patent Application No. PCT/US2019/065267 dated Mar. 27, 2020; 13 pages.

(Continued)

*Primary Examiner* — Aaron L Lembo
(74) *Attorney, Agent, or Firm* — Jeffrey D. Frantz

(57) ABSTRACT

A guide arm with dual guiding functionality is disclosed. The guide arm comprises two parallelogram mechanisms with a slew drive in between. The first parallelogram mechanism may move the guide arm between different travel positions. The slew drive may rotate the second parallelogram mechanism between different clock positions. The second parallelogram mechanism may extend and retract the guide arm. The guide arm may be mounted to a belly board or to a derrick wall rather than on a drill floor. A first guiding functionality may include guiding the lower end of a pipe stand in transfer between a drilling rig well center and a storage position. A second guiding functionality may include guiding the pin end of a single tubular between a drilling operation and a catwalk.

20 Claims, 12 Drawing Sheets

(51) Int. Cl.
*E21B 19/087* (2006.01)
*E21B 19/24* (2006.01)

(56) References Cited

U.S. PATENT DOCUMENTS

| | | | | |
|---|---|---|---|---|
| 6,220,807 | B1 * | 4/2001 | Sorokan | E21B 19/155 414/22.55 |
| 7,246,983 | B2 | 7/2007 | Zahn et al. | |
| 8,317,448 | B2 | 11/2012 | Hankins et al. | |
| 9,752,395 | B2 | 9/2017 | Roodenburg et al. | |
| 11,041,346 | B2 * | 6/2021 | Mikalsen | E21B 19/15 |
| 2004/0206551 | A1 | 10/2004 | Carriere et al. | |
| 2006/0104747 | A1 | 5/2006 | Zahn et al. | |
| 2008/0217067 | A1 | 9/2008 | Ge | |
| 2011/0120730 | A1 | 5/2011 | Clasen et al. | |
| 2012/0020758 | A1 | 1/2012 | Springett et al. | |
| 2013/0327543 | A1 | 12/2013 | Reddy et al. | |
| 2014/0202769 | A1 | 7/2014 | Magnuson | |
| 2015/0232272 | A1 | 8/2015 | Magnuson | |
| 2015/0259984 | A1 | 9/2015 | Taggart et al. | |
| 2015/0330162 | A1 | 11/2015 | Magnuson et al. | |
| 2016/0010323 | A1 | 1/2016 | Konduc et al. | |
| 2016/0168929 | A1 | 6/2016 | Magnuson et al. | |
| 2016/0201408 | A1 | 7/2016 | Little et al. | |
| 2017/0096866 | A1 | 4/2017 | Magnuson | |
| 2017/0241126 | A1 | 8/2017 | Konduc et al. | |
| 2017/0335591 | A1 | 11/2017 | Konduc et al. | |
| 2019/0003269 | A1 * | 1/2019 | Skjærseth | B25J 15/0033 |

FOREIGN PATENT DOCUMENTS

| | | | |
|---|---|---|---|
| WO | 2013169700 | A1 | 11/2013 |
| WO | 2017025577 | A1 | 2/2017 |
| WO | 2018045059 | A1 | 3/2018 |
| WO | 2020123399 | A1 | 6/2020 |
| WO | 2020123494 | A1 | 6/2020 |

OTHER PUBLICATIONS

Search Report and Written Opinion of International Patent Application No. PCT/US2019/065463 dated Apr. 3, 2020; 11 pages.
"Vertical Pipe Handling", MHWirth, Aug. 2017, Rev. 2, 2 pages.

* cited by examiner

GUIDE ARM

CROSS REFERENCE PARAGRAPH

This application claims the benefit of International Application No. PCT/US2019/065463, entitled "GUIDE ARM," filed Dec. 10, 2019, the disclosure of which is hereby incorporated herein by reference.

BACKGROUND

This section is intended to introduce the reader to various aspects of art that may be related to various aspects of the present disclosure, which are described or claimed below. This discussion is believed to be helpful in providing the reader with background information to facilitate a better understanding of the various aspects of the present disclosure. Accordingly, it should be understood that these statements are to be read in this light, and not as admissions of prior art.

This application incorporates by reference the disclosures of U.S. Provisional Application No. 62/778,197, entitled "PIPE RACKING SYSTEM AND METHOD," filed Dec. 11, 2018, and International Application No. PCT/US2019/065267, entitled "PIPE HANDLING SYSTEM AND METHOD," filed Dec. 9, 2019.

This present disclosure relates to pipe handling equipment used on various drilling rigs, like jackup rigs, semisubmersible rigs, drill ships, or land rigs, and, in particular, to equipment used to perform vertical drilling tubular handling operations on the drill floor.

Drilling tubulars include drill pipe, tubing, and casing ("tubulars") which are assembled by threading one section of tubular to the next. Management of tubulars on the drill floor is conducted by various vertical pipe handling components and features that retrieve tubular, position the tubular into the mousehole, and tighten one tubular to the next.

One of these handling components is the guide arm. Known products may comprise both a lower and an upper guide arms. Lower guide arms are known to guide the lower end of pipe stands in the transfer between the drilling operation in the rig well center and the storage position in the set back area. These arms will however have either a manual guiding or a separate drill floor mounted guiding device for guiding the pin end of single tubulars between drilling operation and a catwalk or pipe chute, so called the tail-in functionality.

For this tail-in functionality, numerous tail-in arms or pipe guide arms are available, an example being shown on FIG. 2, either as separate equipment, or as a part of other equipment, i.e. catwalk machines. Known floor mounted guide arm that may be used in conjunction with bridge racker on rigs have the following challenges:

- It needs rails and drive from below, either recessed into the drill floor, or mounted on top.
- It takes space when not in use, and cannot be parked between the two set back sides due to conflict with the pick up and lay out operations.
- The footprint size of a floor mounted guide arm requires space, and normally gives an increase in the alley width between the two set back sides.

SUMMARY

This summary is provided to introduce a selection of concepts that are further described below in the detailed description. This summary is not intended to identify key or essential features of the claimed subject matter, nor is it intended to be used as an aid in determining or limiting the scope of the claimed subject matter as set forth in the claims.

According to some embodiments, it is disclosed a guide arm with dual guiding functionality and a method to guide tubular using the guide arm. By way of a non-limiting example, a first guiding functionality may include guiding the lower end of a pipe stand in transfer between a drilling rig well center and a storage position. A second guiding functionality may include guiding the pin end of a single tubular between a drilling operation and a catwalk.

In embodiments, a method of this disclosure may include moving a guide arm to a first travel position and, when in the first travel position, moving the guide arm between a retracted and an extended position; securing a tubular with a guide head of the guide arm when the guide arm is in the first travel and extended positions; after securing the tubular, returning the guide arm to the retracted position; moving the guide arm to a second different travel position and, when in the second different travel position, moving the guide arm between the retracted and extended positions; and releasing the tubular from the guide head of the guide arm when in the second different travel and extended positions. The first travel position may be the drilling rig well center and the second different position may be a tubular storage position in a set back. Where running in pipe, the first travel position may be the storage position and the second different travel position may be the well center. An alley located between the well center and storage positions may comprise an intermediate travel position.

A guide arm of this disclosure may include two parallelogram mechanisms with a slew drive in between. The upper parallelogram mechanism may include a link and cylinder arrangement, the cylinder providing movement of the guide arm into different travel positions (i.e., travel movements in the alley direction). The lower parallelogram mechanism may include another link and cylinder arrangement, the cylinder providing movement of the guide arm between a retracted and an extended position. The slew drive provides movement of the guide arm into different clock positions. The guide arm also may include a tiltable guide head. The guide arm may include means to fold the arm into a compact, transport friendly mode to facilitate rig moves.

Embodiments of a guide arm of this disclosure may be configured for use as a lower guide arm on a new derrick and drill floor layout, as well as for retrofits and upgrades of existing layouts. In some embodiments, the guide arm may be configured for attachment to a belly board structure. In other embodiments, the guide arm may be configured for attachment to a derrick wall. When in a non-operating position or during extreme environmental conditions or weather-related events, the guide arm may be parked in a vertical orientation along the wall without adding the load that cantilevered guide arms typically add when parked. The guide arm may then swing into the derrick and move to an operating position.

BRIEF DESCRIPTION OF THE DRAWINGS

The subject disclosure is further described in the following detailed description, and the accompanying drawing and schematic of non-limiting embodiment of the subject disclosure. The features depicted in the figure are not necessarily shown to scale. Certain features of the embodiments may be shown exaggerated in scale or in somewhat schematic form, and some details of elements may not be shown in the interest of clarity and conciseness.

DETAILED DESCRIPTION

One or more specific embodiments of the present disclosure will be described below. These described embodiments are only exemplary of the present disclosure. Additionally, in an effort to provide a concise description of these exemplary embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

Figure 1:
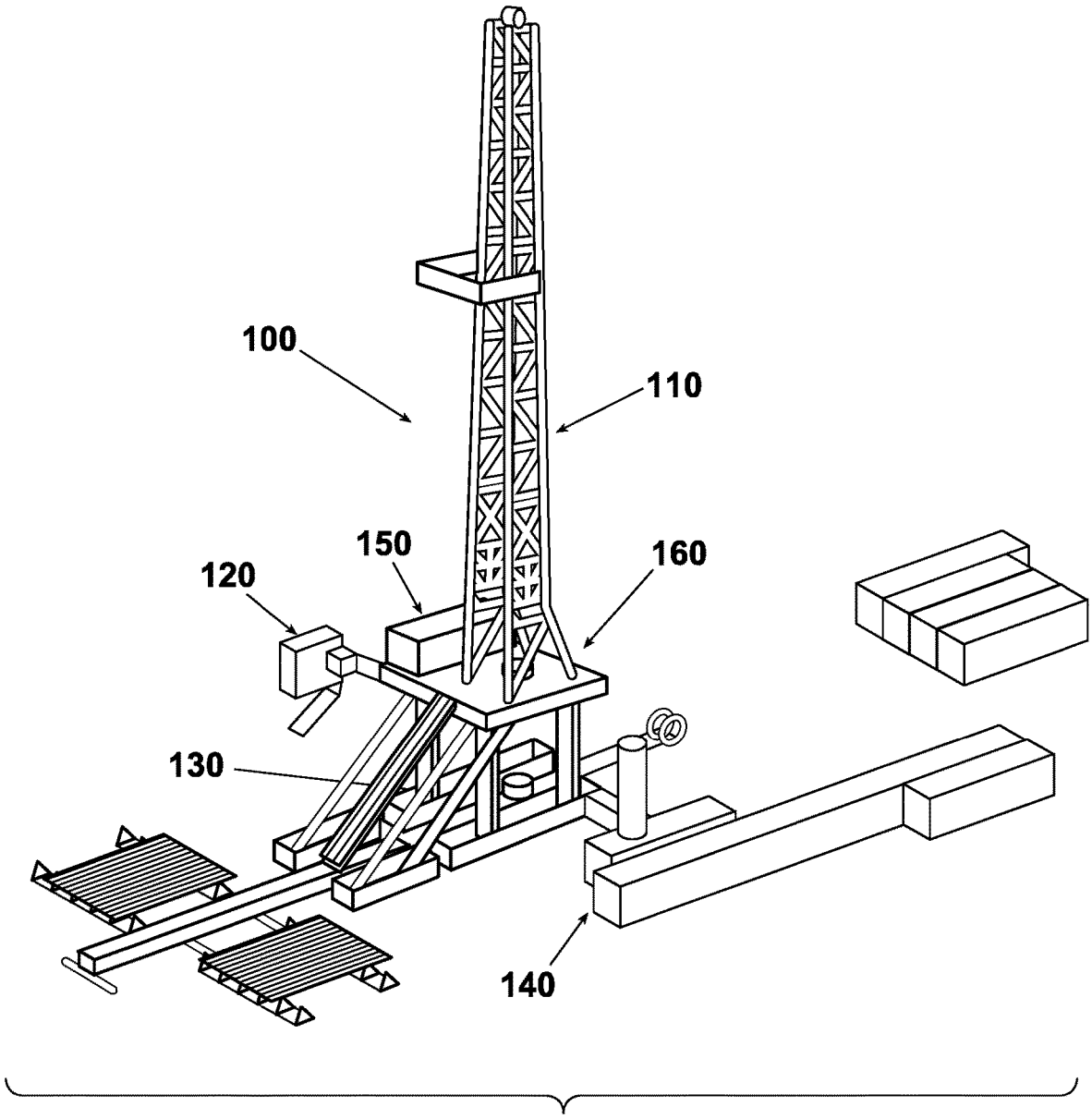
FIG. 1 is a representation of an example of an environment in which one or more of the pipe racking system of the present disclosure might be deployed.
Figure 2:
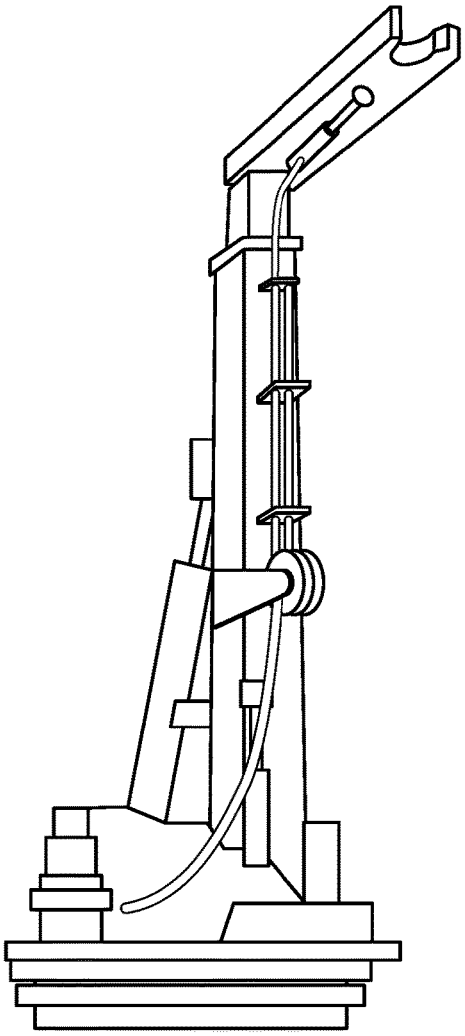
Fig. 2 ( PRIOR ART )
FIG. 2 represents a known guide arm in existing pipe racking systems for offshore rigs.

FIG. 1 is a diagram illustrating an example of the environment in which one or more of the pipe racking system of the present disclosure might be deployed. A land rig 100 is shown which comprises several drilling equipment to drill a subterranean well and produce hydrocarbon-bearing fluid from such subterranean rock formation. The land rig 100 includes tubular handling equipment generally shown as 110, controls skid 120 to power and functionally control the drilling and pressure control equipment, a pressure control system like a Blowout Preventer ("BOP") 130 to control pressure of the well and a manifold system 140 to direct and manage fluids to and from mud pumps. The various equipment and tools of the rig 100 are monitored and controlled from a driller's control room ("DCR") 150, located on the rig floor 160.

The tubular handling equipment might comprise a vertical pipe handler to perform vertical pipe handling operations on the drill floor, including a guide arm(s) to guide pipe stands in their movement on the rig platform.

Some known floor mounted guide arm as may be used in conjunction with bridge racker on rigs, typically offshore ones, have the following challenges, especially for application on land rigs:

- It needs rails and drive from below, either recessed into the drill floor, or mounted on top.
- It takes space when not in use, and cannot be parked between the two set back sides due to conflict with the pick up and lay out operations.
- The footprint size of a floor mounted guide arm requires space, and normally gives an increase in the alley width between the two set back sides.

There is thus a need for a more efficient guide arm that will enable to lower cost, space, and weight of known guide arms, combined with the simplicity of not installing a separate device for tail-in.

In embodiments, a guide arm of the disclosure enables with dual guiding functionality. In embodiments, the guide arm may be guiding the lower end of pipe stands in the transfer between the drilling operation in the rig well center and the storage position in the set back area. In embodiments, the guide arm may be further guiding the pin end of single tubulars between drilling operation and a catwalk or pipe chute, enabling so called tail-in functionality. In embodiments, the guide arm can perform dual guiding for both pick up and lay down operations.

In embodiments of the disclosure, the guide arm comprises two parallelogram mechanisms with a slew drive in between. To engage with the tubular, there may be a tiltable guide head. The hydraulic system and other controls needed to operate a guide arm of this disclosure and components like the guide head may be of a kind well known in the art. In embodiments of the disclosure, the guide arm may be attached to a belly board B structure, such that no arrangements on the drill floor structure might be needed. The arm may fold into a compact transport friendly mode to facilitate rig moves. In other embodiments, the guide arm may be attached to a derrick wall W by a support structure 60 including hinges 61 that permits the guide arm 10 to be parked in a vertical (non-cantilevered) orientation and swung out for use.

Figure 3:
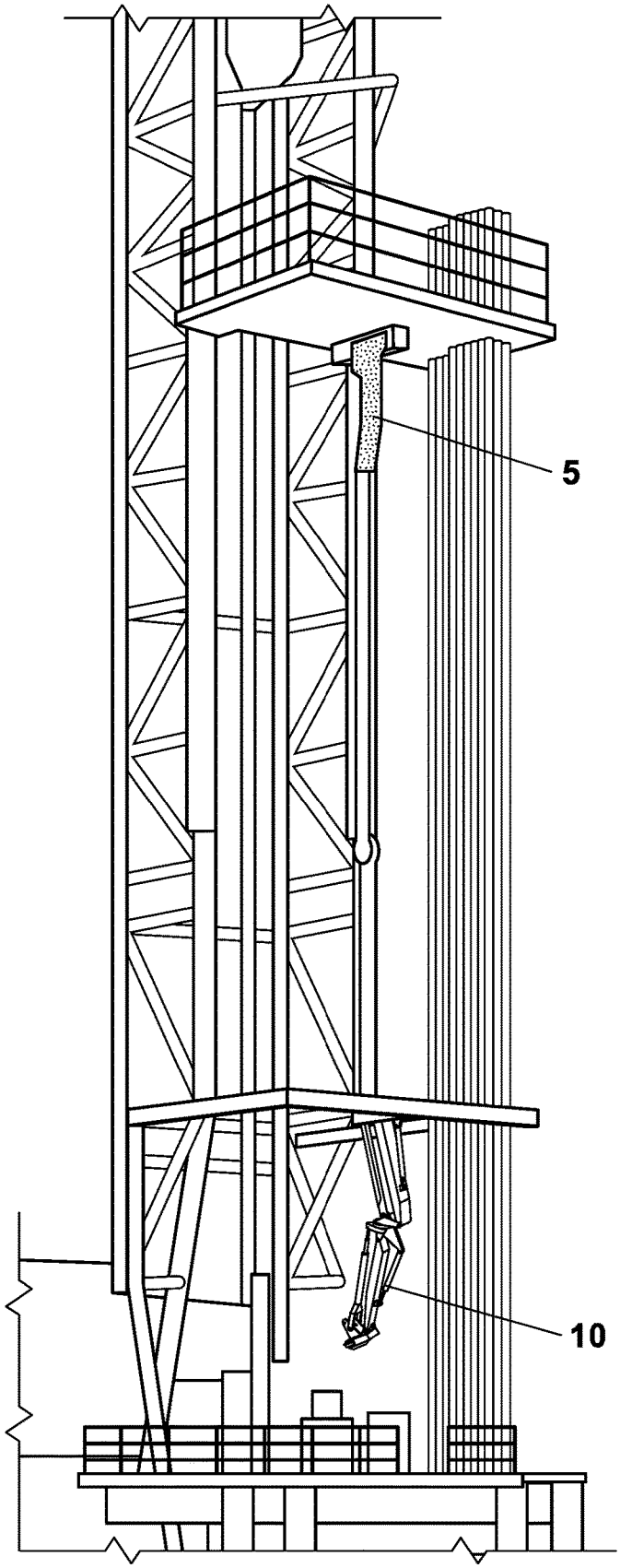
FIG. 3 shows an example of a wellsite system wherein an embodiment of guide arm of the disclosure might be deployed.

An example of a guide arm 10 of the disclosure might be used as a lower guide arm in pipe racking systems where pipes and stands are handled between different locations on the drill floor and in the set back areas. An example of an overall system wherein such arm might be used is represented in FIG. 3. The system may include an upper guide arm 5 of a kind known in the art.

Figure 4:
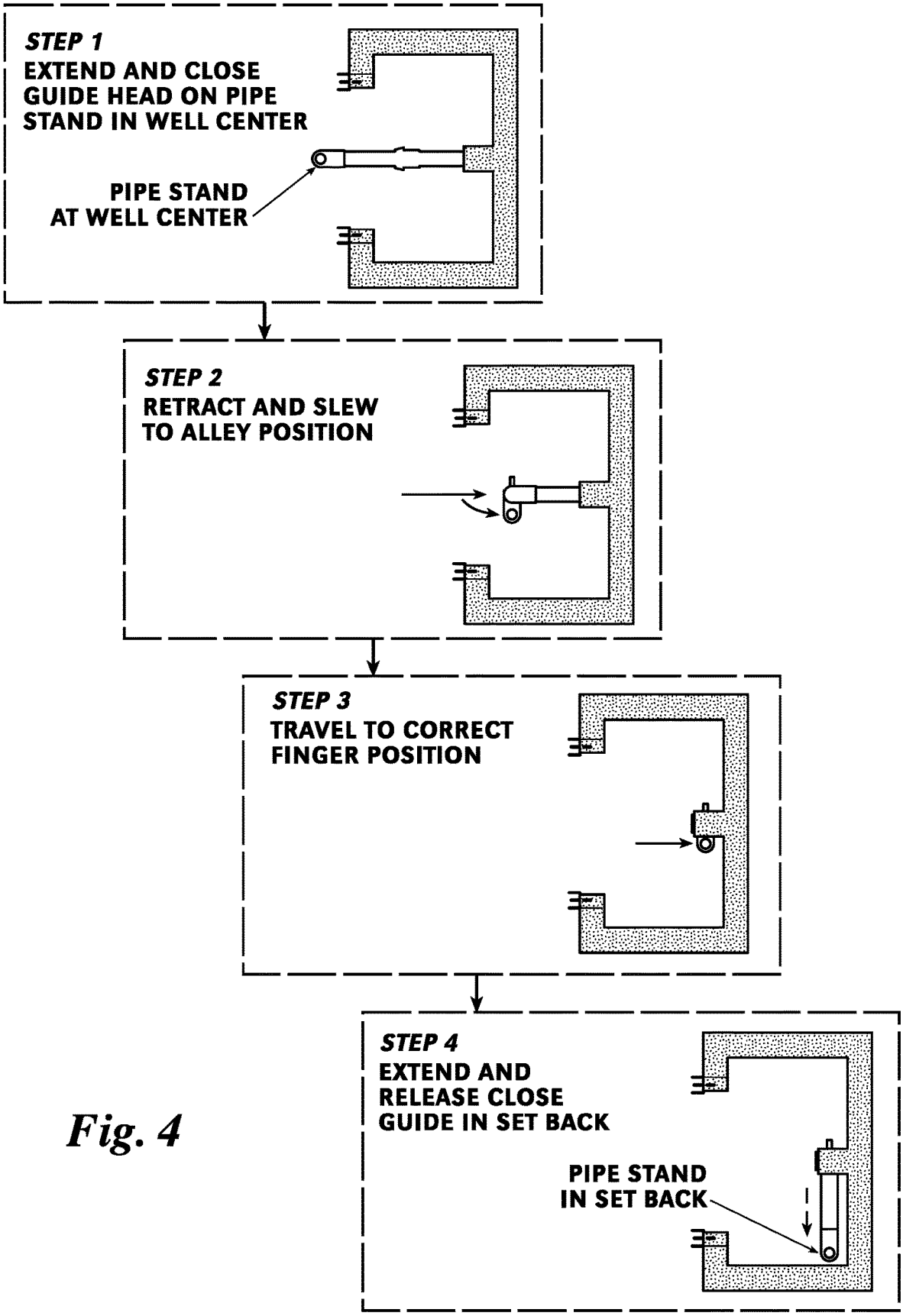
FIG. 4 shows sequences of a racking process wherein a guide arm of the disclosure might be deployed.
Figure 5A:
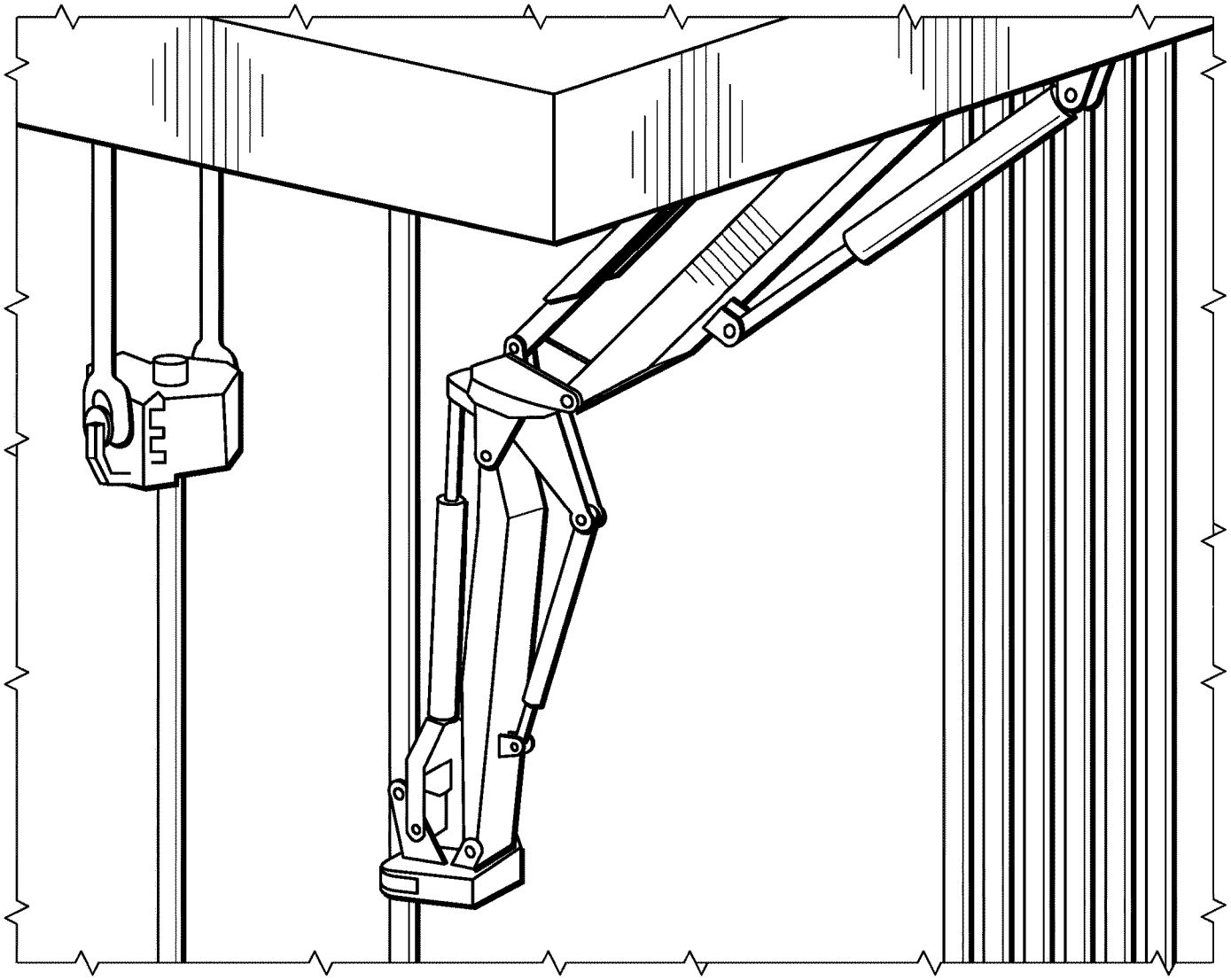
FIG. 5A shows a guide arm of this disclosure in an extended position with the guide head closed on a pipe stand in the well center.
Figure 5B:
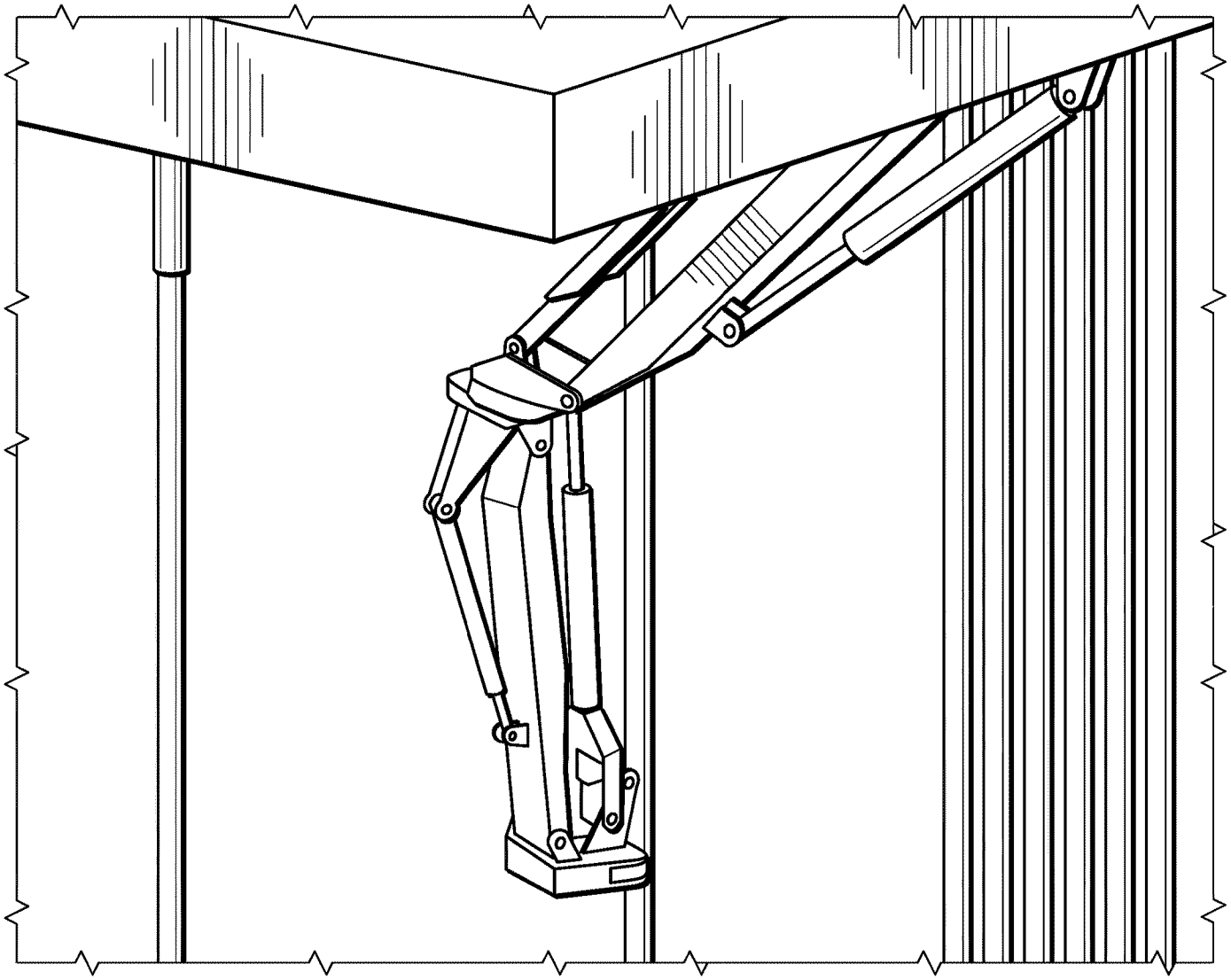
FIG. 5B shows the guide arm of this disclosure in a retracted position and slewed to the alley position.
Figure 5C:
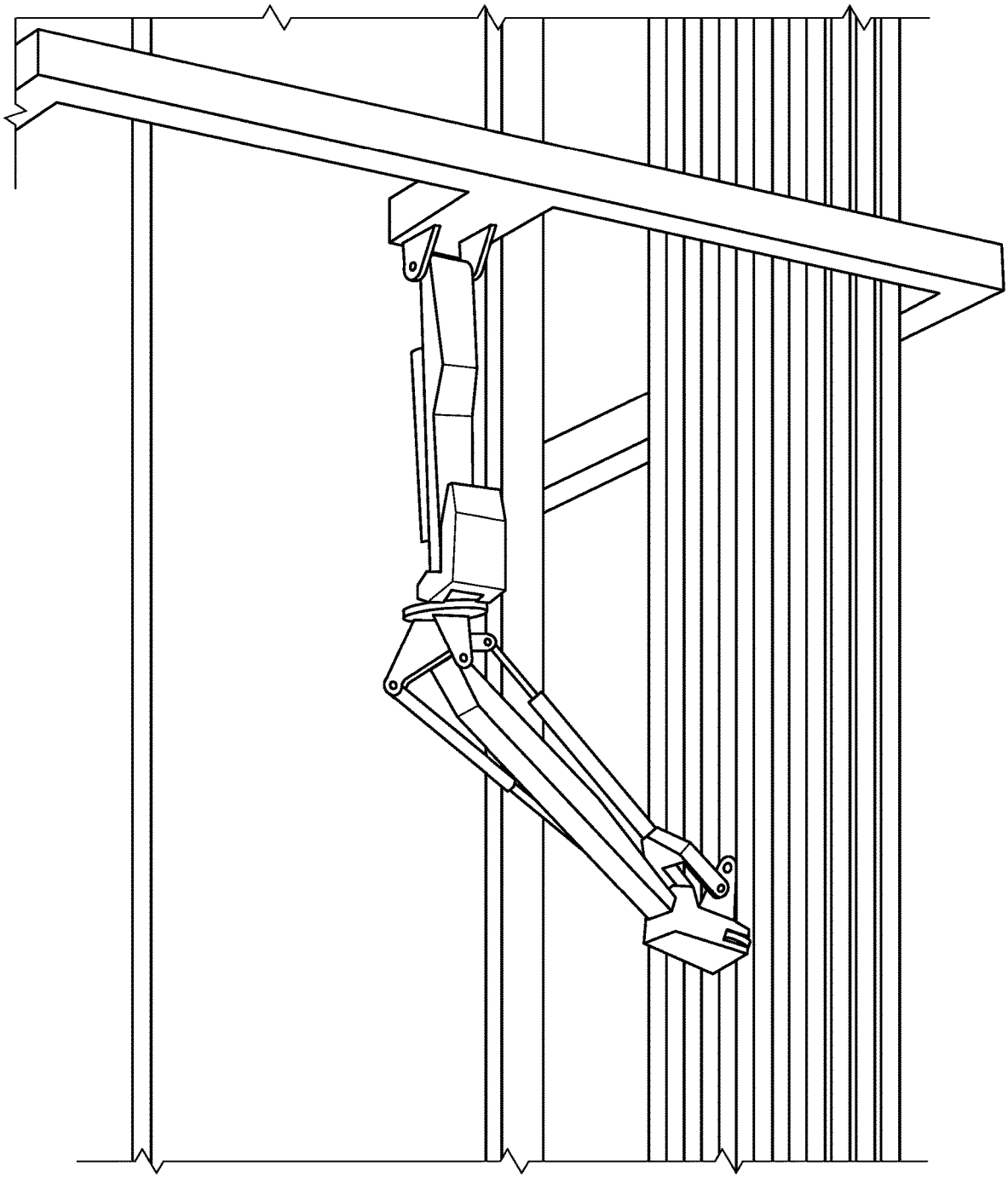
FIG. 5C shows the guide arm of this disclosure travelling to a correct finger position in the setback prior to extending to that position and releasing (opening) the guide head.

FIG. 4 and further detailed in FIGS. 5A to 5C, for steps 1 to 3 of FIG. 4 respectively, are sequences of a racking process wherein a guide arm 10 of an embodiment of the disclosure might be deployed. This process enables to bring pipe stands into the set back area and may be used for automatic racking of drill pipe in the setback of a drilling derrick. Where racking pipe or running in pipe, the guide arm 10 may be configured as a lower guide arm located below an upper guide arm 5.

In embodiments of a method of this disclosure, the guide arm 10 may extend and close the guide head 50 on a pipe stand located in the well center. The well center may be a first travel position. A roughneck machine may loosen the connection of the pipe stand and the guide arm 10 may then retract (with the pipe stand), slew to the alley position, and travel to a correct or next finger position of the set back. The guide arm 10 may then extend to the finger position where the guide head 50 opens and releases the stand. The finger or storage position may be a second different travel position. The guide head 50 may be at a different elevation when extended or retracted in the first and second different travel positions. For example, the guide head 50 may be higher at the well center (e.g., above the roughneck machine) then when at the storage position.

Similarly, where the guide arm 10 is supporting running in pipe, the guide arm 10 may travel to a next finger position in the set back, extend to the next available pipe stand at that position, and close the guide head 50 on the pipe stand. The guide arm 10 may then retract and slew to the alley position and extend to the well center. The guide arm 10 may correctly position the pipe stand for engagement by a roughneck machine above the well center for connection to the drill stem. Again, the process may repeat itself.

Figure 6:
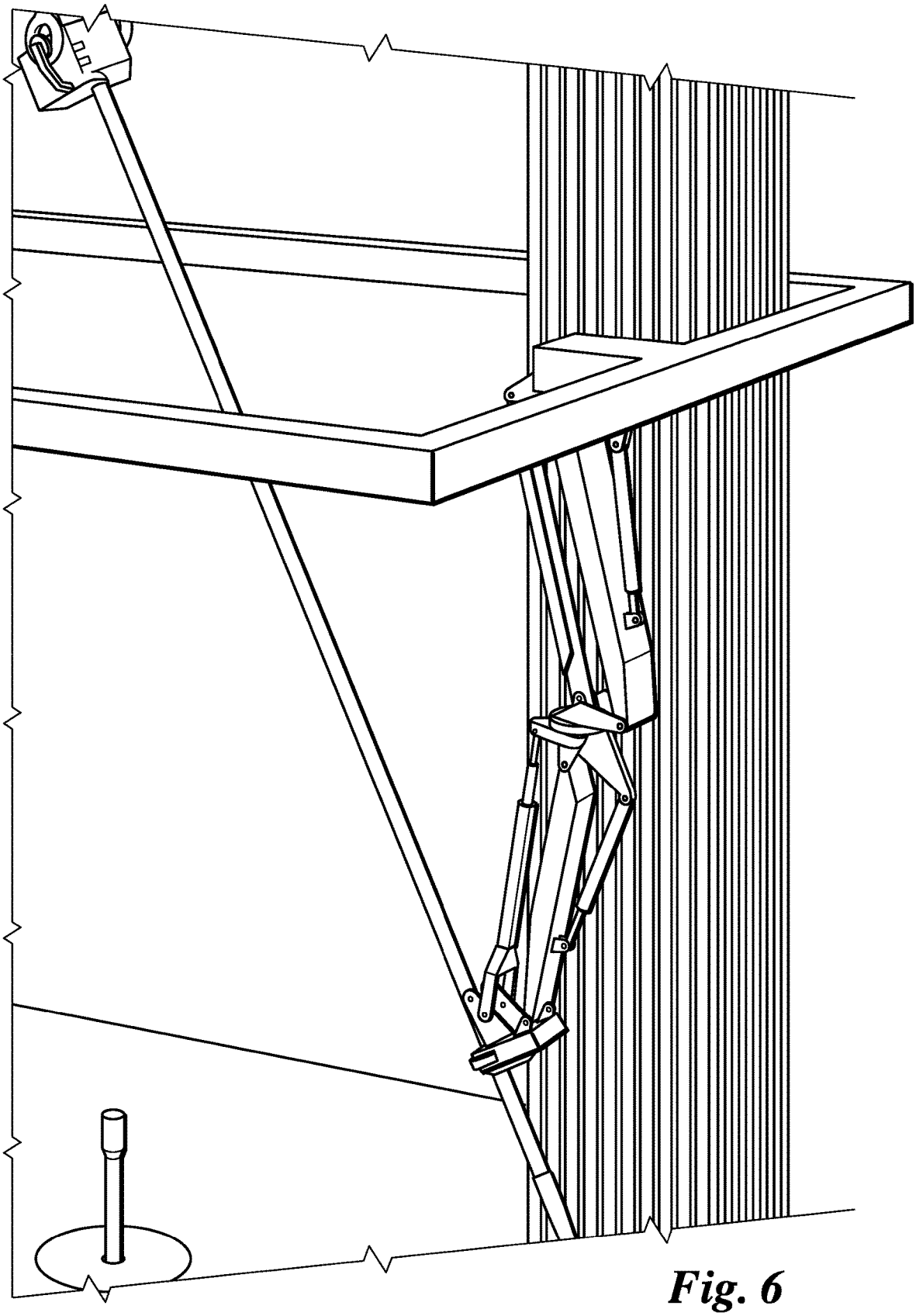
FIG. 6 represents an embodiment of the guide arm of the disclosure in tail-in mode application.

FIG. 6 shows how an embodiment of a guide arm 10 of the disclosure may engage with the lower end of the tubular entering or leaving the drill floor area. In this sequence, the upper end of the tubular might be carried by a top drive or another hoist.

Figure 7:
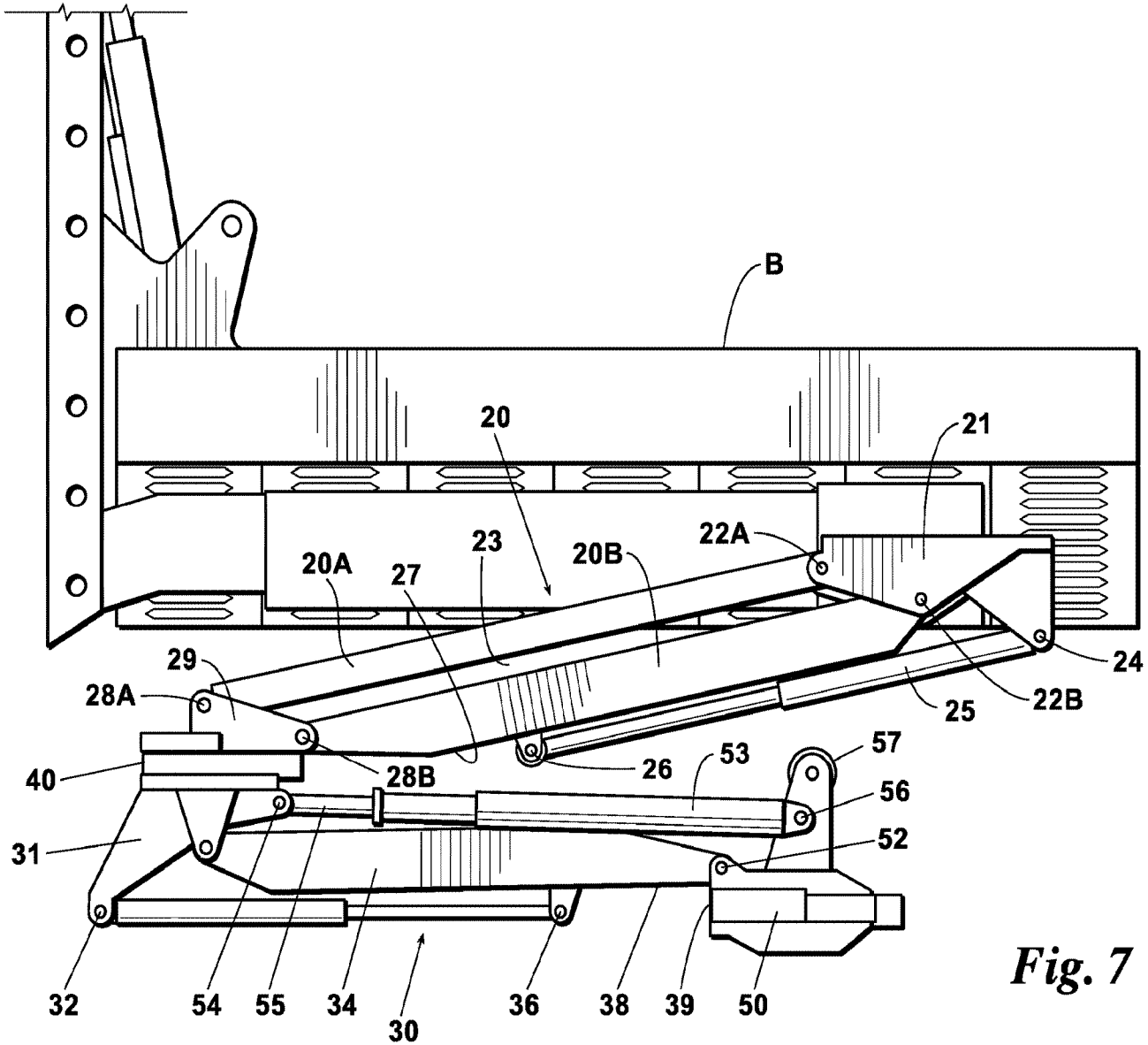
FIG. 7 represents an example of the guide arm of the disclosure in transport mode.

As represented in FIG. 7, for transport, the guide arm 10 might fold up. The compact size might be achieved by the use of the built-in arm movements. For example, embodiments use motions of the arm 10 to move the arm 10 into a compact state for transport rather than relying on parking cylinders or a dismantling procedure.

Figure 8:
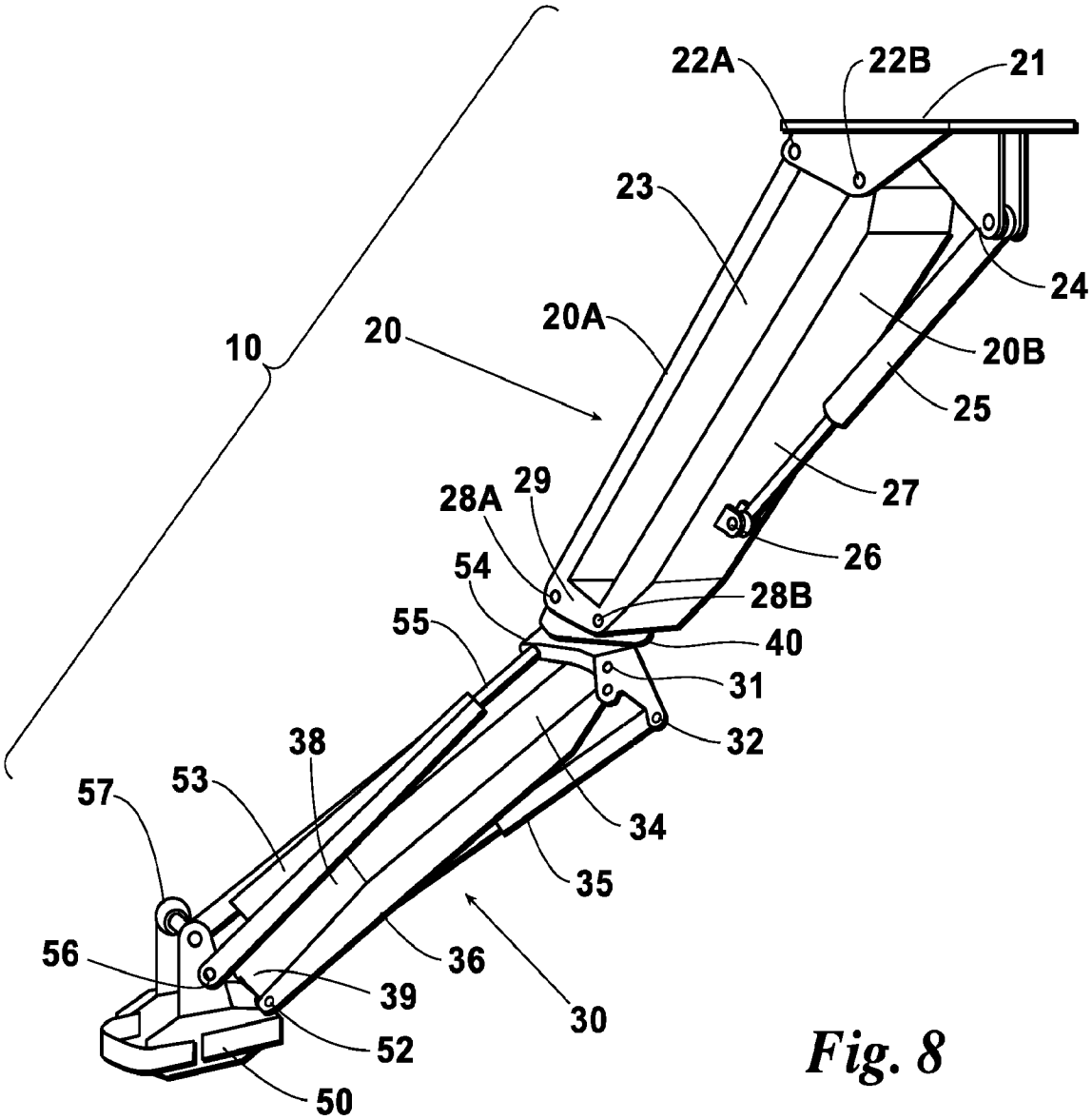
FIG. 8 represents an example of the guide arm in an embodiment of the disclosure.
Figure 9:
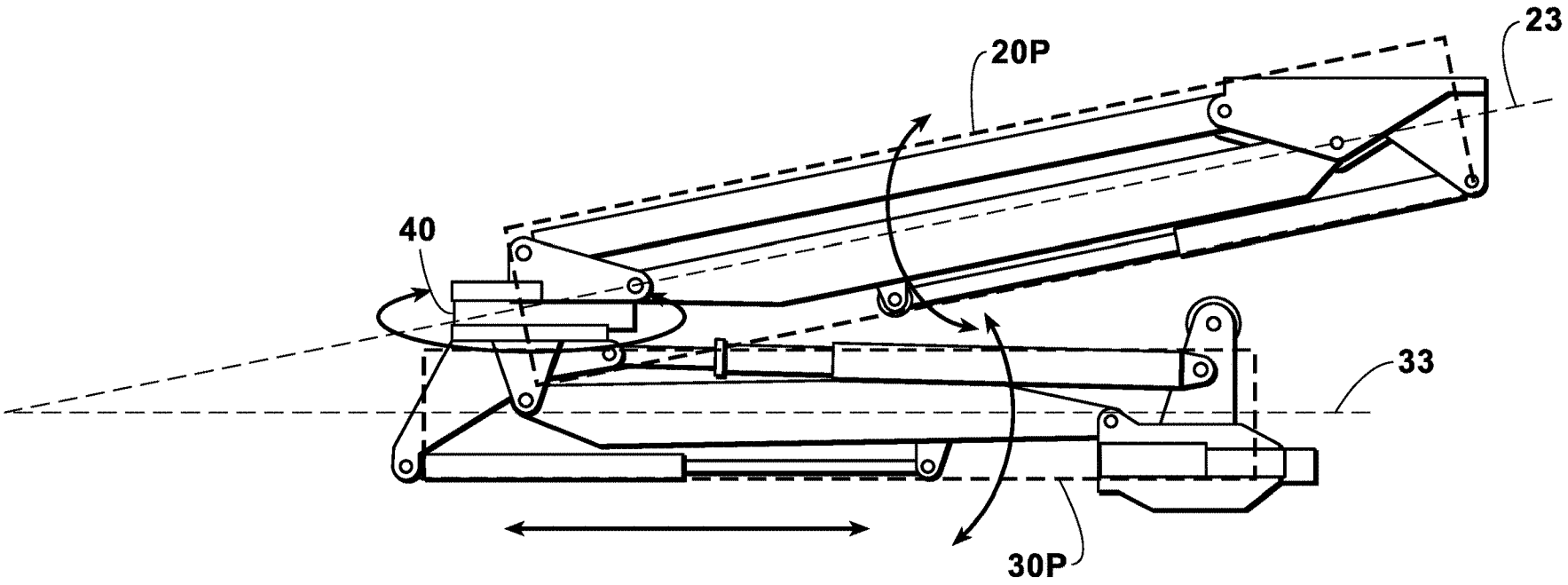
FIG. 9 illustrates the upper and lower parallelogram shapes formed by a guide arm of this disclosure as well as the movement and rotation provided by the guide arm.

As represented in FIGS. 8 and 9, an embodiment of a guide arm of this disclosure may comprise two parallelograms 20, 30 with a slew drive in between. With this configuration, the arm 10 can reach all the positions with a minimum of moving parts, and a narrow but rigid structure.

In embodiments, the upper parallelogram 20P gives the travel movement in the rig center line. The slew drive 40 can orient the lower part or link 30 of the arm 10 in the direction of the fingerboard fingers, or towards the well center. The lower parallelogram 30P might enable the extend/retract movement. A guide head tilt cylinder 55 might lower the guide head 50 for tail-in, and create a tight grip on smaller pipe dimensions in conjunction with a guide roller 57.

Referring to FIGS. 7-9, in embodiments of a system and method of this disclosure, a guide arm 10 configured for handling tubulars may include an upper link 20, a lower link 30, a slew drive 40 located between, and connected to, the links 20, 30, and a guide head 50 connected to the lower link 30 and moveable between an open position to accept a tubular and a closed position to secure the tubular during lifting, lowering, or transport by the guide arm 10. The guide head 50 may include a guide roller 57. The motion of guide arm 10 is analogous to that of a pendulum with fixed length. As previously described, in its lowest position the arm 10 may be straight down (good for tail in/out) and then higher at well center (e.g., above the roughneck machine). When in transport mode the arm 10 can swing up to a horizontal position to save space.

The upper link 20 provides horizontal travel movement. The upper link 20 has a base end 21 containing a pivot 22A, 22B, a slew drive end 29, and a cylinder 25 configured to move the upper link 20 between a first travel position and a second different travel position (e.g. movement in the alley direction) The cylinder 25 may be pivotally connected at one end 24 to the base end 21 and pivotally connected at another end 26 to a lower side 27 of the upper link 20. In some embodiments, the base end 21 may be configured for connection to a belly board B. In other embodiments, the base end 21 may be configured for connection to a swing-out support 60. The swing-out support 60 may be configured for connection to a derrick wall. The upper link 20 may include two spaced apart links 20A, 20B defining an opening 23. The slew drive end 29 may contain pivots 28A, 28B for connection to slew drive 40. The upper link 20 may have a parallelogram shape 20P.

The slew drive 40 may provide for rotation of the lower link 30 between different clock positions (in a horizontal or X-Y plane). The lower link 30 has a guide head end 39, a slew drive end 31 containing a pivot 32, and a cylinder 35 configured to move the lower link 30 in longitudinal direction between a retracted position and an extended position (in an XYZ direction). The cylinder 35 may be pivotally connected at one end 32 to the slew drive end 31 of the lower link 30 and pivotally connected at another end 36 toward the guide head end 39 of the link 30. The lower link 30 may include a fixed portion 34 toward its slew drive end 31 and a telescoping portion 38 toward its guide head end 39. The guide head end 39 of the lower link 30 may include a pivot 52 to which the guide head 50 is connected. A guide head tilt cylinder 55 may be provided and connected at one end 54 to the slew drive end 31 of the lower arm 30 and at another end 56 to the guide head 50. The lower link 30 may have a parallelogram shape 30P.

The guide arm 10 may move between a parked position in which the upper and lower links are each in a substantially vertical orientation and an operational position in which the guide arm 10 may be cantilevered out from the base end 21. The guide arm 10 may have a folded position in which the guide head end 39 of the lower link 30 is located rearward of the slew ends 29, 31 and toward the base end 21 of the upper link 20, the upper link 20 overlapping the lower link 30. When folded, a centerline 23 of the upper link 20 and a centerline 33 of the lower link 30 may lie in the same vertical plane and form an oblique angle.

Figure 10:
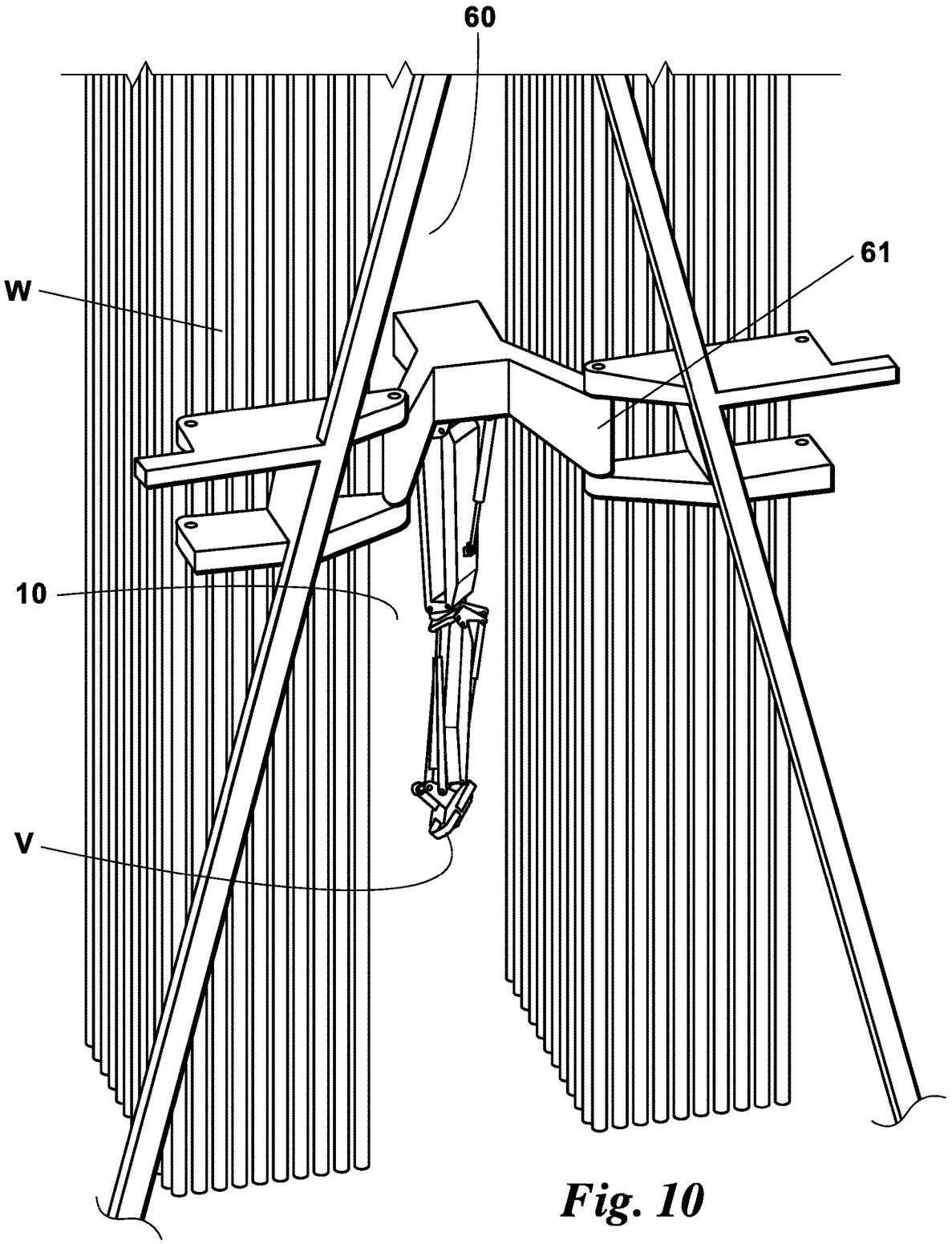
FIG. 10 represents an example of the guide arm of this disclosure when swung into the derrick for use.
Figure 11:
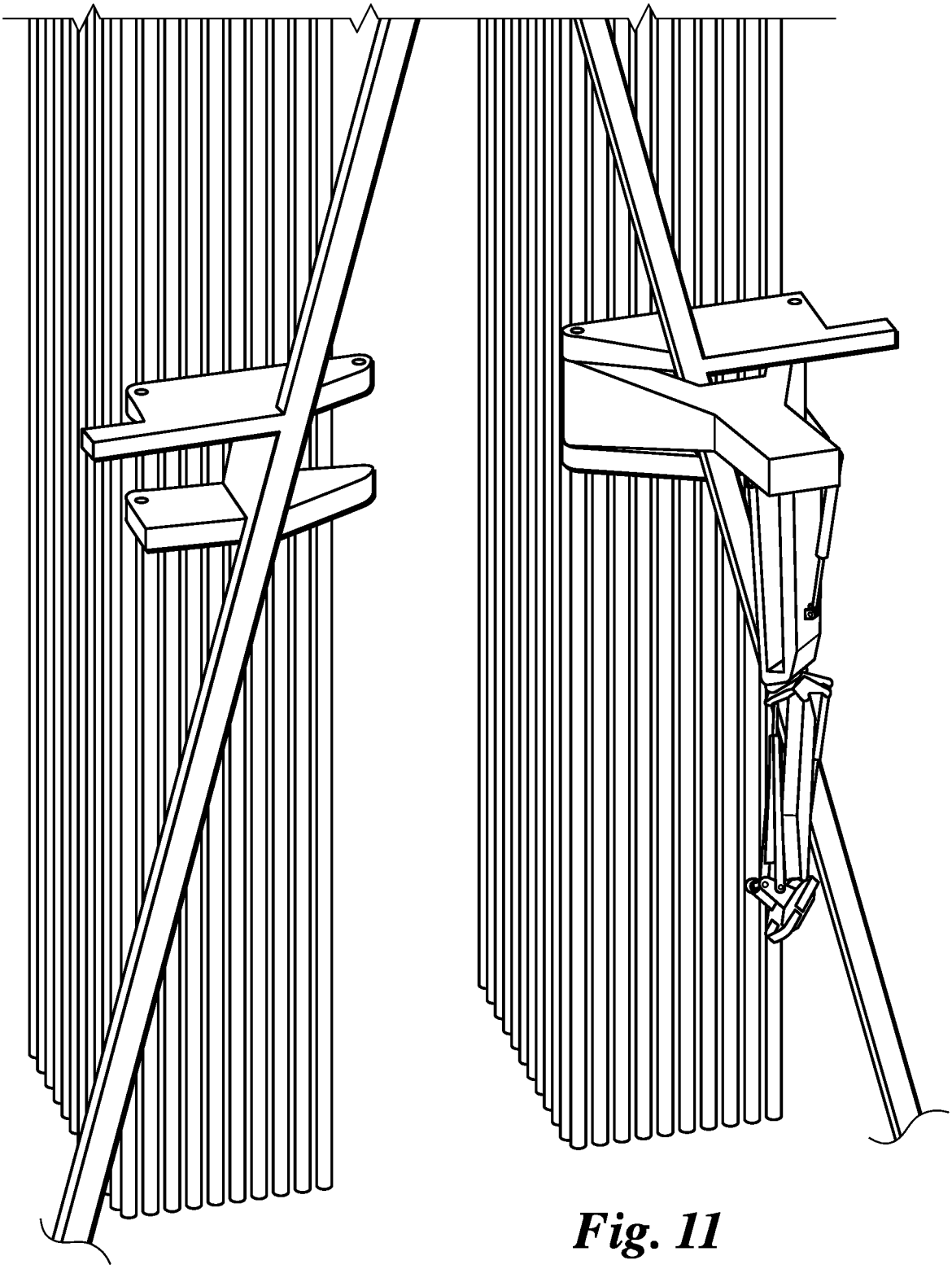
FIG. 11 represents an example of the guide arm of FIG. 10 in a parked position and supported on a wall of an offshore derrick. Parking may be configured to one side or the other. For example, one side may include required cables and hoses and the other side may include the parking bolts.

Referring now to FIGS. 10 and 11 embodiments of a guide arm 10 of this disclosure may be connected to a derrick wall W. The derrick wall may be part of an offshore derrick. The guide arm 10 may be hinged to the wall. By way of a non-limiting example, the guide arm 10 may include a swing-out support 60 that provides for full use of the V-door "V" where required. The hydraulic system and other controls needed to operate the swing-out 60 may be of a kind well known in the art. When the guide arm 10 is parked, the V-door may be used without obstruction by the guide arm 10. When in a parked position, the guide arm 10 may be in a vertical or substantially vertical (non-cantilevered) orientation and, therefore, presents very limited extra loads in the derrick, making the guide arm 10 suitable for use in retrofit applications of an existing drilling package.

Connecting the guide arm 10 to the derrick wall can allow for a fully automated system without affecting the drill floor directly. Embodiments of a guide arm 10 as disclosed herein can allow to provide a lower guide arm for a fully automated pipe handling system where a derrick is equipped with a conventional X-Y set back configuration and a bridge racker system. While the disclosure may be susceptible to various modifications and alternative forms, specific embodiments have been shown by way of example in the drawings and have been described in detail herein. However, it should be understood that the disclosure is not intended to be limited to the particular forms disclosed. Rather, the disclosure is to cover all modifications, equivalents, and alternatives falling within the spirit and scope of the disclosure as defined by the following appended claims.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for" or "step for" performing a function, it is intended that such elements are to be interpreted under 35 U.S.C. 112(f). However, for any claims containing elements designated in any other manner, it is intended that such elements are not to be interpreted under 35 U.S.C. 112(f).

What is claimed:

1. A guide arm for handling tubulars, the guide arm comprising:

an upper link configured to move between a first travel position and a second different travel position;

a lower link including a lower guide head end and configured to move between a retracted position and an extended position;

a slew drive located between the upper and lower links and connected to upper and lower slew drive ends of said respective upper and lower links, the slew drive configured to rotate the lower link between different clock positions;

a guide head connected to the lower guide head end, wherein the guide head includes a pivot and is moveable between an open position to accept a tubular and a closed position about the tubular, wherein the guide head is configured to guide a pin end of a single tubular; and a guide head tilt cylinder connected at one end to the lower slew drive end and at another end to the guide head, wherein the guide head tilt cylinder is configured to rotate the guide head about the lower guide head end of the lower link to tilt the guide head.

2. The guide arm of claim 1, wherein the upper and lower links are parallelogram-shaped links.

3. The guide arm of claim 1, the guide arm having a parked position in which the upper and lower links are each in a substantially vertical orientation.

4. The guide arm of claim 1, wherein the guide arm has a folded position in which the guide head end of the lower link is located rearward of the upper and lower slew drive ends and toward a base end of the upper link, the upper link overlapping the lower link.

5. The guide arm of claim 1, wherein:

the lower link includes a fixed portion toward its lower slew end and a telescoping portion toward its guide head end.

6. The guide arm of claim 1, further comprising:

a belly board, wherein the upper link is connected to the belly board.

7. The guide arm of claim 1, further comprising:

a swing-out support, wherein the upper link is connected to the swing-out support.

8. The guide arm of claim 7, wherein the swing-out support is configured for connection to a derrick wall.

9. The guide arm of claim 1, wherein the guide head is configured to accept the tubular at a single location along a length of the tubular.

10. A system for handing tubulars, the system comprising:

an upper guide arm; and a lower guide arm located below the upper guide arm, the lower guide arm comprising:

an upper link configured to move between a first travel position and a second different travel position;

a lower link including a lower guide head end and configured to move the lower link between a retracted position and an extended position;

a slew drive located between the upper and lower links and connected to an upper and a lower slew drive ends of said respective upper and lower links, the slew drive configured to rotate the lower link between different clock positions;

a guide head connected to the lower guide head end, wherein the guide head includes a pivot and is moveable between an open and a closed position, wherein the guide head is configured to guide a pin end of a single tubular; and a guide head tilt cylinder connected at one end to the lower slew drive end and at another end to the guide head, wherein the guide head tilt cylinder is configured to rotate the guide head about the lower guide head end of the lower link to tilt the guide head.

11. The system of claim 10, wherein:

the upper and lower links are parallelogram-shaped links.

12. The system of claim 10, the lower guide arm having a parked position in which the upper and lower links are each in a substantially vertical orientation.

13. The system of claim 10, wherein the lower guide arm has a folded position in which the lower guide head end is located rearward of the upper and lower slew drive ends and toward a base end of the upper link, the upper link overlapping the lower link.

14. The system of claim 10, wherein:

the lower link includes a fixed portion toward its lower slew drive end and a telescoping portion toward its guide head end.

15. The system of claim 10, further comprising:

a belly board, wherein the upper link is connected to the belly board.

16. The system of claim 10, further comprising:

a swing-out support, wherein the upper link is connected to the swing-out support.

17. The system of claim 16, wherein the swing-out support is configured for connection to a derrick wall.

18. The system of claim 10, wherein the guide head is configured to accept the single tubular at a single location along a length of the tubular.

19. A method of handling tubulars, the method comprising:

moving a guide arm to a first travel position and, when in the first travel position, between a retracted and an extended position;

securing a tubular with a guide head of the guide arm when the guide arm is in the first travel and extended positions, wherein the tubular is secured at a single location along a length of the tubular;

after securing the tubular, returning the guide arm to the retracted position;

moving the guide arm to a second different travel position and, when in the second different travel position, between the retracted and extended positions; and releasing the tubular from the guide head of the guide arm when in the second different travel and extended positions;

wherein the guide arm includes:

an upper link configured to move between a first travel position and a second different travel position;

a lower link including a lower guide head end and configured to move between a retracted position and an extended position;

a slew drive located between the upper and lower links and connected to an upper and a lower slew drive ends of said respective upper and lower links, the slew drive configured to rotate the lower link between different clock positions;

the guide head connected to the lower guide head end and moveable between an open position to accept the tubular and a closed position about the tubular, wherein the guide head is configured to guide a pin end of a single tubular; and a guide head tilt cylinder connected at one end to the lower slew drive end and at another end to the guide head, wherein the guide head tilt cylinder is configured to rotate the guide head about the lower guide head end of the lower link to tilt the guide head.

20. The method of claim 19, wherein the first travel and second different travel positions are selected from the group of well center and tubular storage.

* * * * *